US010109958B2

(12) United States Patent
Carbone et al.

(10) Patent No.: US 10,109,958 B2
(45) Date of Patent: Oct. 23, 2018

(54) ELECTRICAL CONNECTION SYSTEM FOR SHIELDED WIRE CABLE

(71) Applicant: Delphi Technologies, Inc., Troy, MI (US)

(72) Inventors: Klara P. Carbone, Cortland, OH (US); Leslie L. Jones, Garretsville, OH (US); Joon Lee, Carmel, IN (US); Nicole L. Liptak, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/803,125

(22) Filed: Nov. 3, 2017

(65) Prior Publication Data

US 2018/0054028 A1 Feb. 22, 2018

Related U.S. Application Data

(63) Continuation-in-part of application No. 15/369,973, filed on Dec. 6, 2016, which is a continuation-in-part of application No. 14/101,472, filed on Dec. 10, 2013.

(51) Int. Cl.

| | |
|---|---|
| ***H01R 13/6592*** | (2011.01) |
| ***H01B 11/00*** | (2006.01) |
| ***H01B 7/18*** | (2006.01) |
| ***H01B 11/10*** | (2006.01) |
| ***H01R 24/56*** | (2011.01) |
| ***H01R 13/05*** | (2006.01) |
| ***H01R 13/422*** | (2006.01) |
| ***H01B 1/02*** | (2006.01) |

(Continued)

(52) U.S. Cl.

CPC ..... *H01R 13/6592* (2013.01); *H01B 1/026* (2013.01); *H01B 3/30* (2013.01); *H01B 7/1875* (2013.01); *H01B 11/002* (2013.01); *H01B 11/1091* (2013.01); *H01R 9/035* (2013.01); *H01R 13/05* (2013.01); *H01R 13/422* (2013.01); *H01R 13/6593* (2013.01); *H01R 24/56* (2013.01); *H01R 13/6582* (2013.01); *H01R 2105/00* (2013.01)

(58) Field of Classification Search

CPC .. H01R 13/6592; H01R 13/05; H01R 13/422; H01R 24/56; H01B 7/1875; H01B 11/002; H01B 11/1091

USPC ..... 439/357; 174/176

See application file for complete search history.

(56) References Cited

U.S. PATENT DOCUMENTS

| | | | |
|---|---|---|---|
| 4,453,798 | A | 6/1984 | Asick et al. |
| 5,769,648 | A | 6/1998 | Hayashi et al. |

(Continued)

FOREIGN PATENT DOCUMENTS

| | | | |
|---|---|---|---|
| JP | 10241791 | A | 9/1998 |
| JP | 2009099300 | A | 5/2009 |

(Continued)

*Primary Examiner* — Timothy Thompson
*Assistant Examiner* — Charles Pizzuto
(74) *Attorney, Agent, or Firm* — Robert J. Myers

(57) ABSTRACT

An electrical connection system configured to terminate electrical connectors and to transmit digital electrical signals having a data transfer rate of 5 Gigabits per second (Gb/s) or higher. The system includes a first parallel mirrored pair of terminals having a planar connection portion and a second pair of parallel mirrored terminals having a cantilever beam portion and a contact point configured to contact the first terminals.

11 Claims, 10 Drawing Sheets

(51) Int. Cl.

| | |
|---|---|
| ***H01B 3/30*** | (2006.01) |
| ***H01R 9/03*** | (2006.01) |
| ***H01R 13/6593*** | (2011.01) |
| *H01R 105/00* | (2006.01) |
| *H01R 13/6582* | (2011.01) |

(56) References Cited

U.S. PATENT DOCUMENTS

| | | | | |
|---|---|---|---|---|
| 6,039,610 | A | 3/2000 | Pauza et al. | |
| 6,244,885 | B1 | 6/2001 | Iwahori | |
| 6,441,308 | B1 | 8/2002 | Gagnon | |
| 6,508,678 | B1 | 1/2003 | Yang | |
| 6,504,397 | B1 | 3/2003 | Grant et al. | |
| 8,303,343 | B2 | 11/2012 | Nagata | |
| 2003/0022544 | A1 | 1/2003 | Hattori | |
| 2003/0114037 | A1 | 6/2003 | Abe | |
| 2005/0121223 | A1 | 6/2005 | Wu | |
| 2011/0034072 | A1 | 2/2011 | Feldman et al. | |
| 2011/0065304 | A1 | 3/2011 | Zhang | |
| 2014/0262424 | A1* | 9/2014 | Liptak | H01B 11/002 174/106 R |
| 2015/0311643 | A1* | 10/2015 | Gundel | H01B 7/0861 174/74 R |
| 2016/0268739 | A1* | 9/2016 | Zerebilov | H01R 24/60 |
| 2017/0365943 | A1* | 12/2017 | Wanha | H01R 13/6471 |

FOREIGN PATENT DOCUMENTS

| | | | |
|---|---|---|---|
| JP | 2011253724 | A | 12/2011 |
| JP | 2013182753 | A | 9/2013 |

* cited by examiner

| STANDARD | RISE TIME | NOMINAL IMPEDANCE | MINIMUM IMPEDANCE | MAXIMUM IMPEDANCE |
|---|---|---|---|---|
| HDMI 1.4 | 200 ps | 100 Ω | 85 Ω | 115 Ω |
| USB 3.0 | 50 ps | 90 Ω | 76.5 Ω | 105 Ω |
| COMBINED | 50 ps | 95 Ω | 85 Ω | 105 Ω |

FIG. 3

| | | |
|---|---|---|
| DIELECTRIC STRENGTH | 0.5 KILOVOLTS/MINUTE | |
| MAXIMUM DC RESISTANCE AT 20° C | 350Ω/km | |
| IMPEDANCE (TDR) | 95 Ω | |
| INTERPAIR SKEW | < 15 ps/METER | |
| ATTENUATION/7 METERS | ≤ 1.5 DECIBELS(dB) | @ < 100 MEGAHERTZ (MHz) |
| | ≤ 5 dB | @ < 100 MHz - 1250 MHz |
| | ≤ 7.5 dB | @ < 1250 MHz - 2500 MHz |
| | ≤ 25 dB | @ < 2500 MHz - 7500 MHz |
| BENDING RADIUS | ≤ 31 mm | |

FIG. 4

ELECTRICAL CONNECTION SYSTEM FOR SHIELDED WIRE CABLE

CROSS-REFERENCE TO RELATED APPLICATION

This application is a continuation-in-part application and claims the benefit under 35 U.S.C. § 120 of U.S. patent application Ser. No. 15/369,973, filed Dec. 6, 2016 which claims the benefit under 35 U.S.C. § 120 of U.S. patent application Ser. No. 14/101,472, filed Dec. 12, 2013, the entire disclosure of both of which is hereby incorporated herein by reference.

TECHNICAL FIELD OF INVENTION

The invention generally relates to an electrical connection system, and more particularly relates to an electrical connection system designed to connect shielded wire cables capable of differentially transmitting digital electrical signals having a data transfer rate of 5 Gigabits per second (Gb/s) or higher further requiring frequency content to 7.5 Gigahertz (GHz).

BACKGROUND OF THE INVENTION

The increase in digital data processor speeds has led to an increase in data transfer speeds. Transmission media used to connect electronic components to the digital data processors must be constructed to efficiently transmit the high speed digital signals between the various components. Wired media, such as fiber optic cable, coaxial cable, or twisted pair cable may be suitable in applications where the components being connected are in fixed locations and are relatively close proximity, e.g. separated by less than 100 meters. Fiber optic cable provides a transmission medium that can support data rates of up to nearly 100 Gb/s and is practically immune to electromagnetic interference. Coaxial cable typically supports data transfer rates up to 100 Megabits per second (Mb/s) and has good immunity to electromagnetic interference. Twisted pair cable can support data rates of up to about 5 Gb/s, although these cables typically require multiple twisted pairs within the cable dedicated to transmit or receive lines. The conductors of the twisted pair cables offer good resistance to electromagnetic interference which can be improved by including shielding for the twisted pairs within the cable.

Data transfer protocols such as Universal Serial Bus (USB) 3.0 and High Definition Multimedia Interface (HDMI) 1.4 require data transfer rates at or above 5 Gb/s. Existing coaxial cable cannot economically or reliably be implemented to support data rates near this speed. Both fiber optic and twisted pair cables are capable of transmitting data at these transfer rates, however fiber optic cables are significantly more expensive than twisted pair, making them less attractive for cost sensitive applications that do not require the high data transfer rates and electromagnetic interference immunity.

Infotainment systems and other electronic systems in automobiles and trucks are beginning to require cables capable of carrying high data rate signals. Automotive grade cables must not only be able to meet environmental requirements (e.g. thermal and moisture resistance), they must also be flexible enough to be routed in a vehicle wiring harness and have a low mass to help meet vehicle fuel economy requirements. Therefore, there is a need for a wire cable with a high data transfer rate that has low mass and is flexible enough to be packaged within a vehicle wiring harness, while meeting cost targets that cannot currently be met by fiber optic cable. Although the particular application given for this wire cable is automotive, such a wire cable would also likely find other applications, such as aerospace, maritime, industrial control, or other data communications.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an electrical connection system is provided. The electrical connection system includes a first electrical conductor and a second electrical conductor, wherein a first consistent spacing is maintained between the first and second electrical conductors and a third electrical conductor and a fourth electrical conductor, wherein a second consistent spacing is maintained between the third and fourth electrical conductors. The electrical connection system further includes a plug connector having a first plug terminal including a planar first connection portion characterized by a generally rectangular cross section and a first attachment portion attached to the first electrical conductor and having a second plug terminal including a planar second connection portion characterized by a generally rectangular cross section and a second attachment portion attached to the second electrical conductor. A spacing between the first and second attachment portions maintains the first consistent spacing between the first and second electrical conductors. The first and second plug terminals form a first mirrored terminal pair having bilateral symmetry about a longitudinal axis and a receptacle connector configured to mate with said plug connector. The receptacle connector has a first receptacle terminal including a third attachment portion attached the third electrical conductor and a first cantilever beam portion characterized by a generally rectangular cross section defining a convex first contact point depending from the first cantilever beam portion. The first contact point is configured to contact the first connection portion of the first plug terminal. The receptacle connector also has a second receptacle terminal including a fourth attachment portion attached to the fourth electrical conductor and having a second cantilever beam portion characterized by a generally rectangular cross section defining a convex second contact point depending from the second cantilever beam portion. The second contact point is configured to contact the second connection portion of the second plug terminal. A spacing between the third and fourth attachment portions maintains the second consistent spacing between the third and fourth electrical conductors. The first and second receptacle terminals form a second mirrored terminal pair having bilateral symmetry about the longitudinal axis. When the plug connector is connected to the receptacle connector, a major width of the first connection portion is substantially perpendicular to a major width of the first cantilever beam portion and a major width of the second connection portion is substantially perpendicular to a major width of the second cantilever beam portion.

The first receptacle terminal may define a first tab extending inwardly toward the second receptacle terminal and the second receptacle terminal may define a second tab extending inwardly toward the first receptacle terminal, thereby decreasing a distance between the first and second receptacle terminals and increasing capacitive coupling between the first and second receptacle terminals.

The first and second plug terminals may be partially encased within a plug terminal holder formed of a dielectric material and configured to maintain a lateral separation of the first and second attachment portions. The first and second receptacle terminals may be partially encased within a receptacle terminal holder formed of a dielectric material and configured to maintain lateral separation of the third and fourth attachment portions. The receptacle terminal holder may define a pair of channels adjacent the first and second receptacle terminals configured to allow vertical deflection of the first and second receptacle terminals.

The electrical connection system may further include a plug shield electrically isolated from the plug connector and configured to be attached to a first shield conductor and to longitudinally surround the plug connector and a receptacle shield electrically isolated from the receptacle connector and configured to be attached to a second shield conductor and to longitudinally surround the receptacle connector. The plug shield is configured to slideably engage the interior of the receptacle shield.

The plug shield may define an outward embossment proximate a location of the first and second attachment portions of the first and second plug terminals, thereby increasing a distance between the first and second attachment portions and the plug shield and decreasing capacitive coupling between the first and second plug terminals and the plug shield. The receptacle shield may define an outward embossment proximate a location of the third and fourth attachment portions of the first and second receptacle terminals, thereby increasing a distance between the third and fourth attachment portions and the receptacle shield and decreasing capacitive coupling between the first and second receptacle terminals and the receptacle shield.

The receptacle shield may define an inward embossment proximate a location of first tab of the first receptacle terminal and the second tab extending of the second receptacle terminal, thereby decreasing a distance between the first and second tabs and the receptacle shield and increasing capacitive coupling between the first and second receptacle terminals and the receptacle shield.

The first and second electrical conductors may be in a shielded wire cable or conductive circuit board traces. The third and fourth electrical conductors may also be in a shielded wire cable or conductive circuit board traces.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which:

FIG. 3 is a chart illustrating the signal rise time and desired cable impedance of several high speed digital transmission standards as measured from 10-90% of signal rise;

FIG. 4 is a chart illustrating various performance characteristics of the wire cable of FIGS. 1 and 2 in accordance with one embodiment;

DETAILED DESCRIPTION OF THE INVENTION

Presented herein is an electrical connector assembly for a shielded wire cable assembly that is capable of carrying digital signals at rates up to 5 Gigabits per second (Gb/s) (5 billion bits per second) to support both USB 3.0 and HDMI 1.4 performance specifications. The wire cable assembly includes a wire cable having a pair of conductors (wire pair) and a conductive sheet and braided conductor to isolate the wire pair from electromagnetic interference and determine the characteristic impedance of the cable. The wire pair is encased within dielectric belting that helps to provide a consistent radial distance between the wire pair and the shield. The belting may also help to maintain a consistent twist angle between the wire pair if they are twisted. The consistent radial distance between the wire pair and the shield and the consistent twist angle provides a wire cable with more consistent impedance. The wire cable assembly may also include an electrical receptacle connector having a mirrored pair of plug terminals connected to the wire pair and/or an electrical plug connector having a mirrored pair of receptacle terminals connected to the wire pair that is configured to mate with the plug terminals of the plug connector. The receptacle and plug terminals each have a generally rectangular cross section and when the first and second electrical connectors are mated, the major widths of the receptacle terminals are substantially perpendicular to the major widths of the plug terminals and the contact points between the receptacle and plug terminals are external to the receptacle and plug terminals. Both the receptacle and plug connectors include a shield that longitudinally surrounds the receptacle or plug terminals and is connected to the braided conductor of the wire cable. The wire cable assembly may also include an insulative connector body that contains the receptacle or plug terminals and shield.

Figure 1:
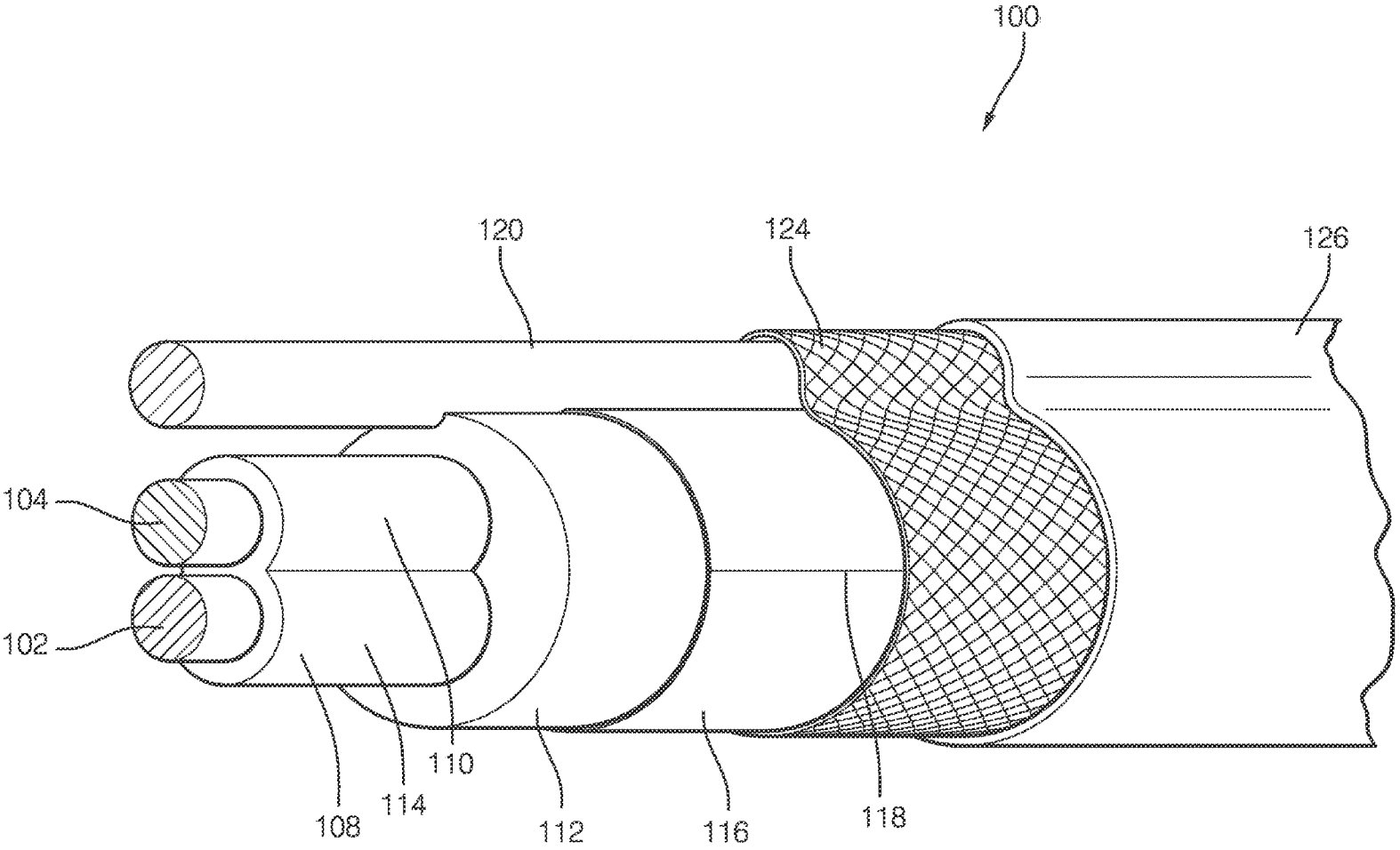
FIG. 1 is a perspective cut away drawing of a shielded wire cable in accordance with one embodiment.
Figure 2:
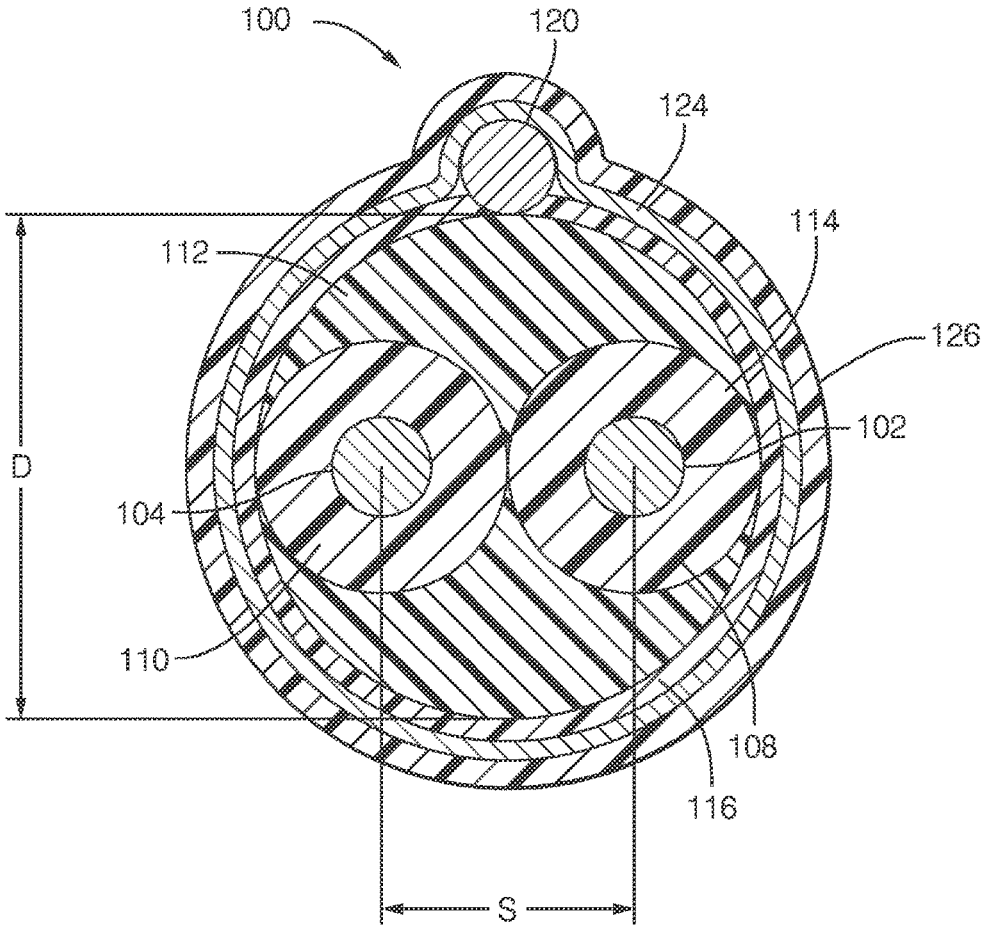
FIG. 2 is a cross section drawing of the wire cable of FIG. 1 in accordance with one embodiment.

FIGS. 1 and 2 illustrate a non-limiting example of a wire cable 100 used in the wire cable assembly. The wire cable 100 includes a central pair of conductors comprising a first inner conductor, hereinafter referred to as the first conductor 102 and a second inner conductor, hereinafter referred to as the second conductor 104. The first and second conductors 102, 104 are formed of a conductive material with superior conductivity, such as unplated copper or silver plated copper. As used herein, copper refers to elemental copper or a copper-based alloy. Further, as used herein, silver refers to elemental silver or a silver-based alloy. The design, construction, and sources of copper and silver plated copper conductors are well known to those skilled in the art. The first and second conductors 102, 104 each comprise a solid wire conductor, such as a bare (non-plated) copper wire or silver plated copper wire having a diameter of about 0.321 millimeters (mm), which is generally equivalent to 28 AWG solid wire. Alternatively, the first and second conductors 102, 104 may be formed of a solid wire having a smaller or larger gauge, such as 30 AWG or 26 AWG respectively. Alternative embodiments of the wire cable may use stranded wire for the first and second conductors 102, 104.

The central pair of first and second conductors 102, 104 may be longitudinally twisted over a lay length L, for example once every 15.24 mm. Twisting the first and second conductors 102, 104 provides the benefit of reducing low frequency electromagnetic interference of the signal carried by the central pair. However, the inventors have discovered that satisfactory signal transmission performance may also be provided by a wire cable wherein the first and second conductors 102, 104 are not twisted about one about the other. Not twisting the first and second conductors 102, 104 may provide the benefit of reducing manufacturing cost of the wire cable by eliminating the twisting process. Not twisting the first and second conductors 102, 104 results in reduced differential insertion loss but has the disadvantage of requiring specific limitations in vehicle routing, specifically to non-uniform bending along the length of the cable run.

Each of the first and second conductors 102, 104 are enclosed within a respective first dielectric insulator and a second dielectric insulator, hereafter referred to as the first and second insulators 108, 110. The first and second insulators 108, 110 are bonded together. The first and second insulators 108, 110 run the entire length of the wire cable 100, except for portions that are removed at the ends of the cable in order to terminate the wire cable 100. The first and second insulators 108, 110 are formed of a flexible dielectric material, such as polypropylene. The first and second insulators 108, 110 may be characterized as having a thickness of about 0.85 mm.

Bonding the first insulator 108 to the second insulators 110 helps to maintain a consistent spacing S between the first and second conductors 102, 104. The methods required to manufacture a pair of conductors with bonded insulators are well known to those skilled in the art.

The first and second conductors 102, 104 and the first and second insulators 108, 110 are completely enclosed within a third dielectric insulator, hereafter referred to as the belting 112, except for portions that are removed at the ends of the cable in order to terminate the wire cable 100. The first and second insulators 108, 110 and the belting 112 together form a dielectric structure.

The belting 112 is formed of a flexible dielectric material, such as polyethylene. As illustrated in FIG. 2, the belting may be characterized as having a diameter D of 2.22 mm. A release agent 114, such as a talc-based powder, may be applied to an outer surface of the bonded first and second insulators 108, 110 in order to facilitate removal of the belting 112 from the first and second insulators 108, 110 when ends of the first and second insulators 108, 110 are stripped from the first and second conductors 102, 104 to form terminations of the wire cable 100.

The belting 112 is completely enclosed within a conductive sheet, hereafter referred to as the inner shield 116, except for portions that may be removed at the ends of the cable in order to terminate the wire cable 100. The inner shield 116 is longitudinally wrapped in a single layer about the belting 112, so that it forms a single seam 118 that runs generally parallel to the central pair of first and second conductors 102, 104. The inner shield 116 is not spirally wrapped or helically wrapped about the belting 112. The seam edges of the inner shield 116 may overlap, so that the inner shield 116 covers at least 100 percent of an outer surface of the belting 112. The inner shield 116 is formed of a flexible conductive material, such as aluminized biaxially oriented PET film. Biaxially oriented polyethylene terephthalate film is commonly known by the trade name MYLAR and the aluminized biaxially oriented PET film will hereafter be referred to as aluminized MYLAR film. The aluminized MYLAR film has a conductive aluminum coating applied to only one of the major surfaces; the other major surface is non-aluminized and therefore non-conductive. The design, construction, and sources for single-sided aluminized MYLAR films are well known to those skilled in the art. The non-aluminized surface of the inner shield 116 is in contact with an outer surface of the belting 112. The inner shield 116 may be characterized as having a thickness of less than or equal to 0.04 mm.

The belting 112 provides the advantage of maintaining transmission line characteristics and providing a consistent radial distance between the first and second conductor 102, 104 and the inner shield 116. The belting 112 further provides an advantage of keeping the twist lay length between the first and second conductors 102, 104 consistent. Shielded twisted pair cables found in the prior art typically only have air as a dielectric between the twisted pair and the shield. Both the distance between first and second conductors 102, 104 and the inner shield 116 and the effective twist lay length of the first and second conductors 102, 104 affect the wire cable impedance. Therefore a wire cable with more consistent radial distance between the first and second conductors 102, 104 and the inner shield 116 provides more consistent impedance. A consistent twist lay length of the first and second conductors 102, 104 also provides controlled impedance.

Alternatively, a wire cable may be envisioned incorporating a single dielectric structure encasing the first and second insulators to maintain a consistent lateral distance between the first and second insulators and a consistent radial distance between the first and second insulators and the inner shield. The dielectric structure may also keep the twist lay length of the first and second conductors consistent.

As shown in FIGS. 1 and 2, the wire cable 100 additionally includes a ground conductor, hereafter referred to as the drain wire 120 that is disposed outside of the inner shield 116. The drain wire 120 extends generally parallel to the first and second conductors 102, 104 and is in intimate contact or at least in electrical communication with the aluminized outer surface of the inner shield 116. The drain wire 120 comprises a solid wire conductor, such as an unplated copper conductor, tin plated copper conductor, or silver plated copper conductor having a cross section of about 0.321 $mm^2$, which is generally equivalent to 28 AWG solid wire. Alternatively, the drain wire 120 may be formed of solid wire having a smaller gauge, such as 30 AWG or 32 AWG. Alternative embodiments of the wire cable may use stranded wire for the drain wire 120. The design, construction, and sources of copper and tin plated copper conductors are well known to those skilled in the art.

As illustrated in FIGS. 1 and 2, the wire cable 100 further includes a braided wire conductor, hereafter referred to as the outer shield 124, enclosing the inner shield 116 and the drain wire 120, except for portions that may be removed at the ends of the cable in order to terminate the wire cable 100. The outer shield 124 is formed of a plurality of woven conductors, such as copper or tin plated copper. As used herein, tin refers to elemental tin or a tin-based alloy. The design, construction, and sources of braided conductors used to provide such an outer shield are well known to those skilled in the art. The outer shield 124 is in intimate contact or at least in electrical communication with both the inner shield 116 and the drain wire 120. The wires forming the outer shield 124 may be in contact with at least 65 percent of an outer surface of the inner shield 116. The outer shield 124 may be characterized as having a thickness less than or equal to 0.30 mm.

The wire cable 100 shown in FIGS. 1 and 2 further includes an outer dielectric insulator, hereafter referred to as the jacket 126. The jacket 126 encloses the outer shield 124, except for portions that may be removed at the ends of the cable in order to terminate the wire cable 100. The jacket 126 forms an outer insulation layer that provides both electrical insulation and environmental protection for the wire cable 100. The jacket 126 is formed of a flexible dielectric material, such as polyvinyl chloride (PVC). The jacket 126 may be characterized as having a thickness of about 0.2 mm.

The wire cable 100 is constructed so that the inner shield 116 is tight to the belting 112, the outer shield 124 is tight to the drain wire 120 and the inner shield 116, and the jacket 126 is tight to the outer shield 124 so that the formation of air gaps between these elements is minimized or compacted. This provides the wire cable 100 with controlled magnetic permeability.

The wire cable 100 may be characterized as having a differential impedance of 95 Ohms.

FIG. 3 illustrates the requirements for signal rise time (in picoseconds (ps)) and differential impedance (in Ohms (Ω)) for the USB 3.0 and HDMI 1.4 performance specifications. FIG. 3 also illustrates the combined requirements for a wire cable capable of simultaneously meeting both USB 3.0 and HDMI 1.4 standards. The wire cable is expected to meet the combined USB 3.0 and HDMI 1.4 signal rise time and differential impedance requirements shown in FIG. 7.

FIG. 4 illustrates the differential impedances that are expected for the wire cables 100 over a signal frequency range of 0 to 7500 MHz (7.5 GHz).

Figure 5:
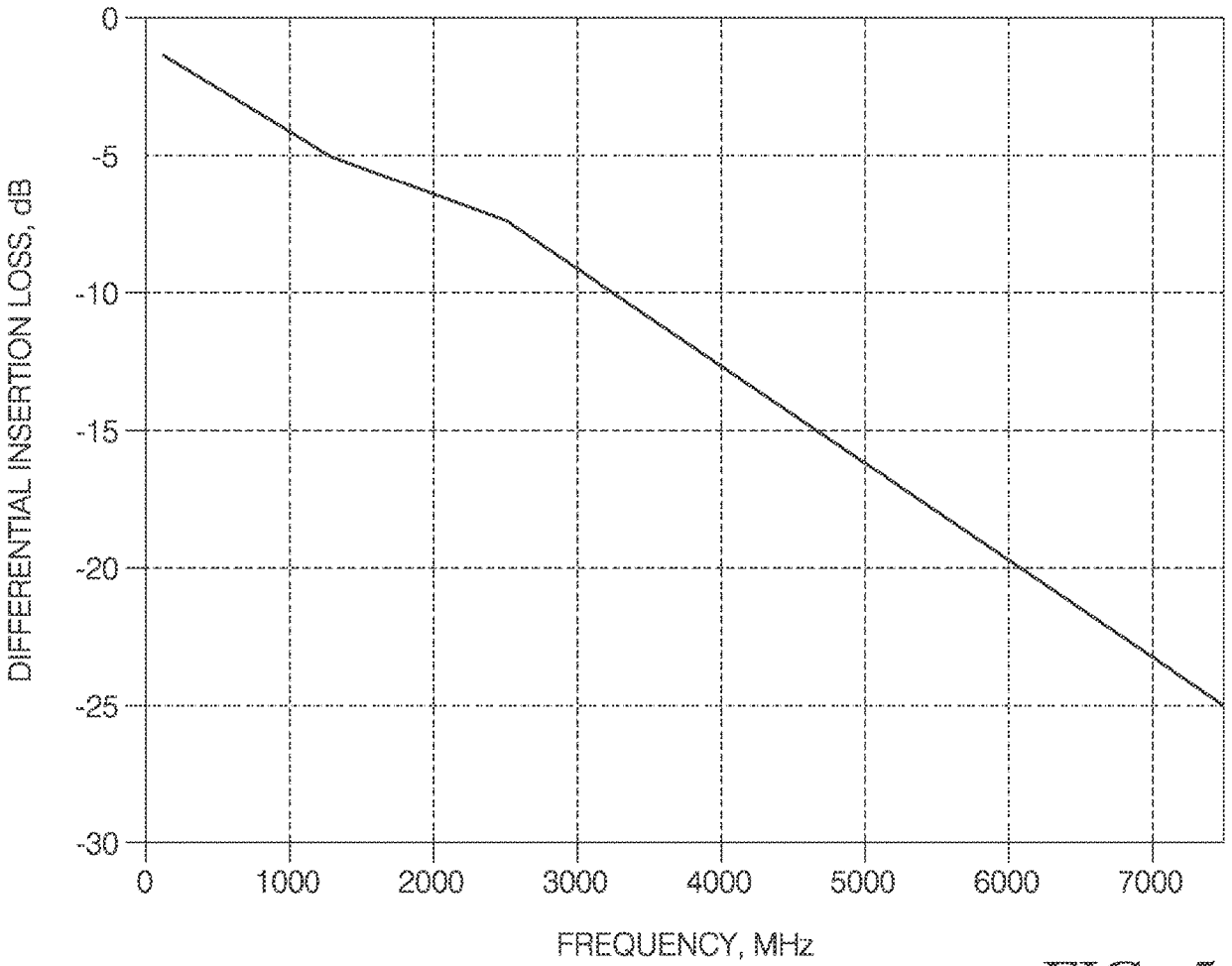
FIG. 5 is a graph of the differential insertion loss versus signal frequency of the wire cables of FIGS. 1 and 2 in accordance with one embodiment.

FIG. 5 illustrates the insertion losses that are expected for wire cable 100 with a length of 7 m over the signal frequency range of 0 to 7500 MHz (7.5 GHz).

Therefore, as shown in FIGS. 4 and 5, the wire cable 100 having a length of up to 7 meters are expected to be capable of transmitting non return to zero (NRZ) digital data at a speed of up to 5 Gigabits per second with an insertion loss of less than 20 dB.

Figure 6:
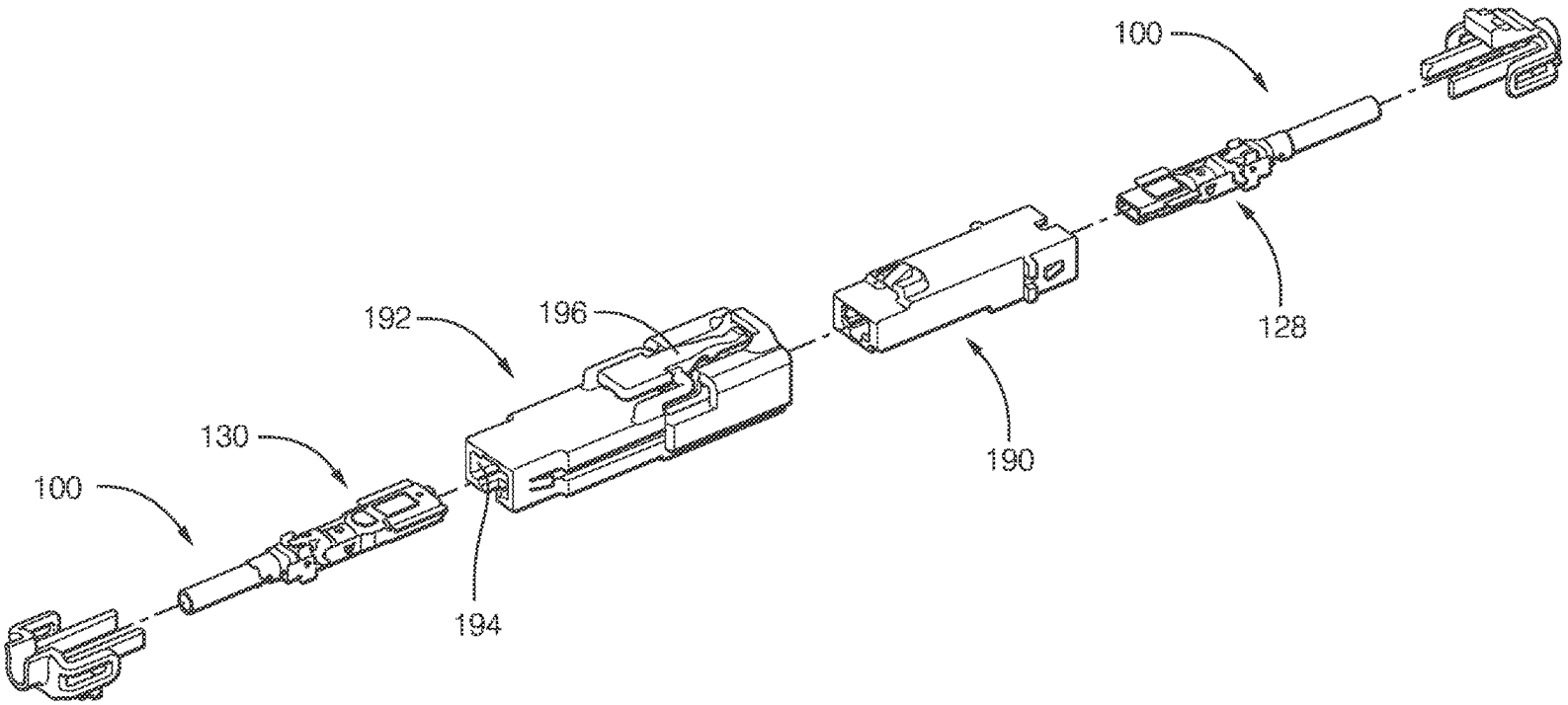
FIG. 6 is an exploded perspective view of a wire cable assembly in accordance with one embodiment.
Figure 7:
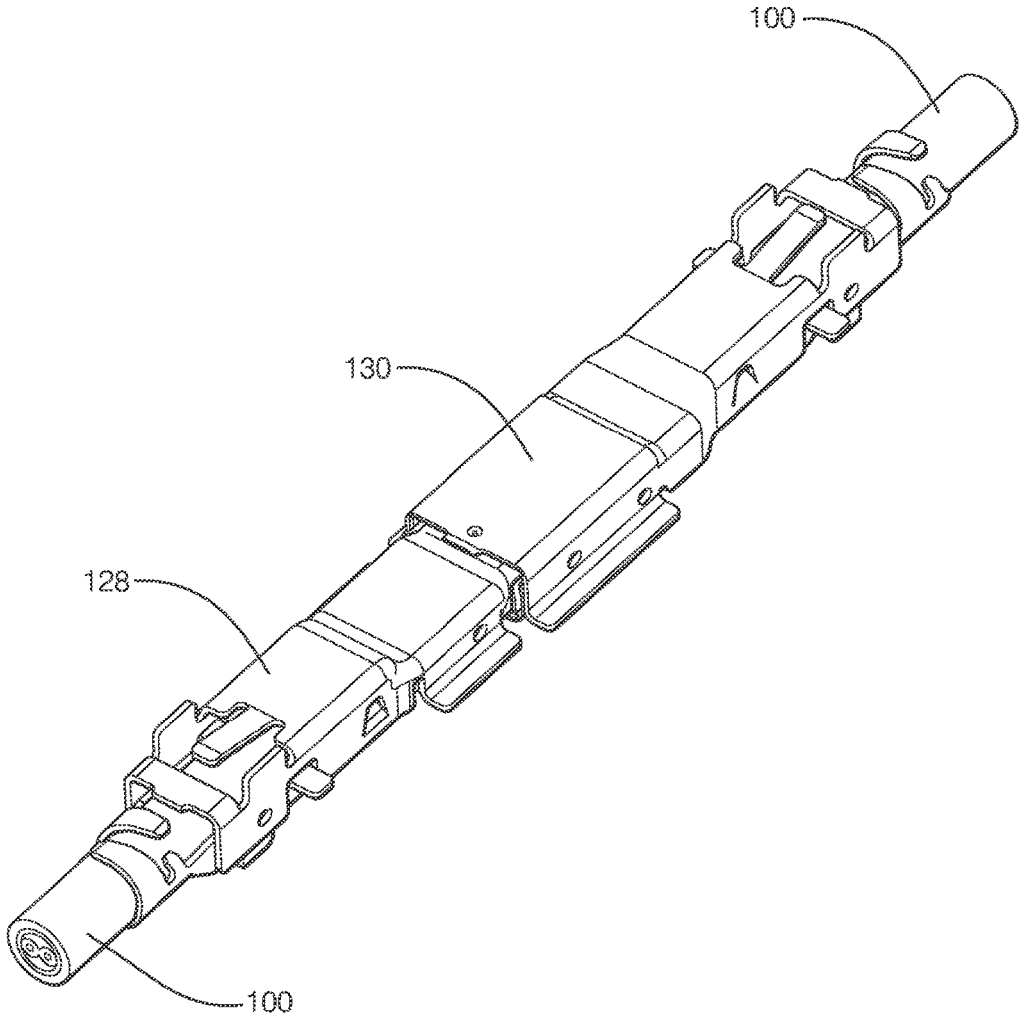
FIG. 7 is a perspective view of an electrical connector system of the wire cable assembly of FIG. 6 in accordance with one embodiment.

As illustrated in the non-limiting example of FIG. 6, the wire cable assembly includes an electrical connector assembly. The connector assembly includes a receptacle connector 128 and a plug connector 130 configured to accept the receptacle connector 128 as illustrated in FIG. 7.

Figure 8:
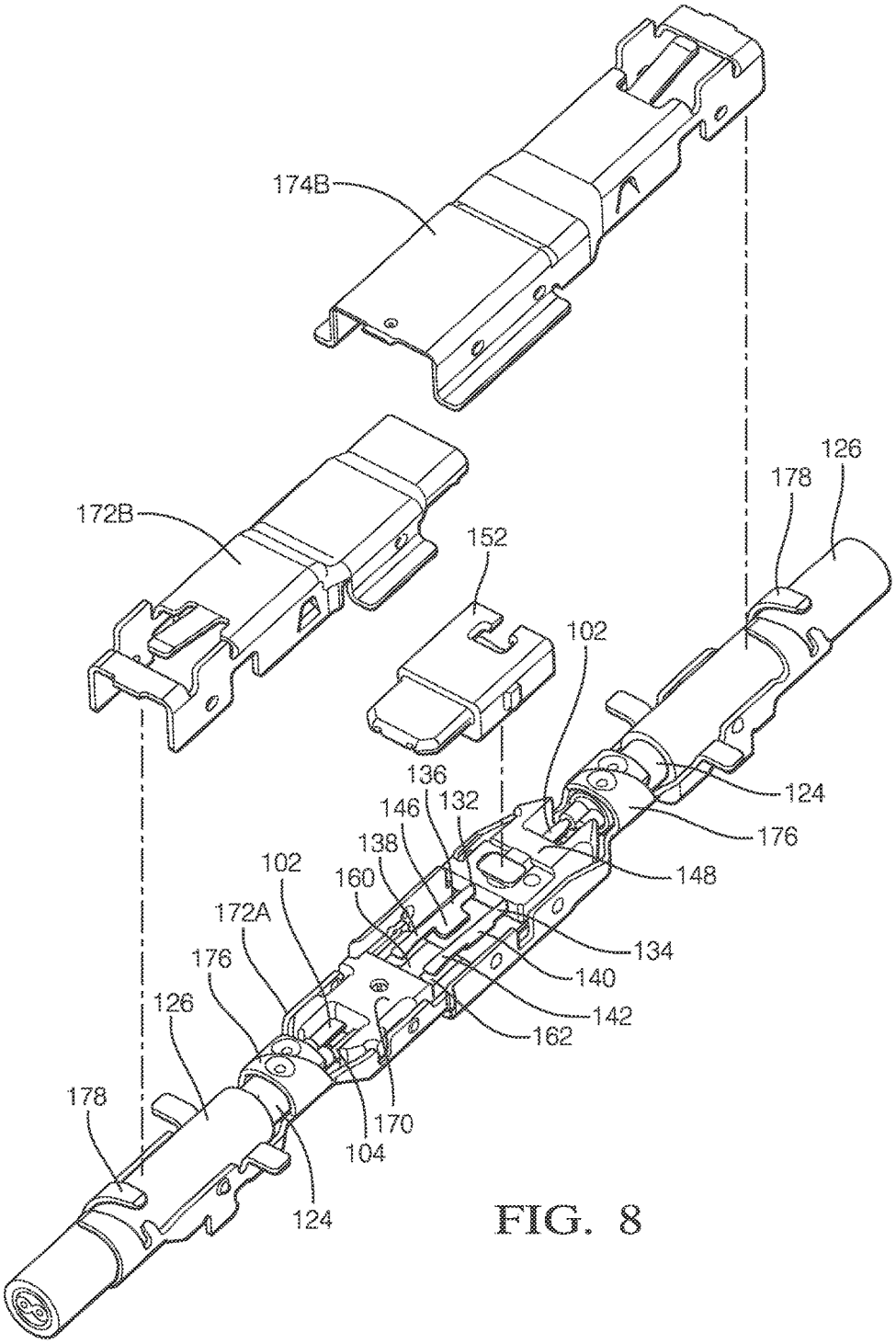
FIG. 8 is an exploded perspective view of the electrical connector system of FIG. 7 in accordance with one embodiment.
Figure 9:
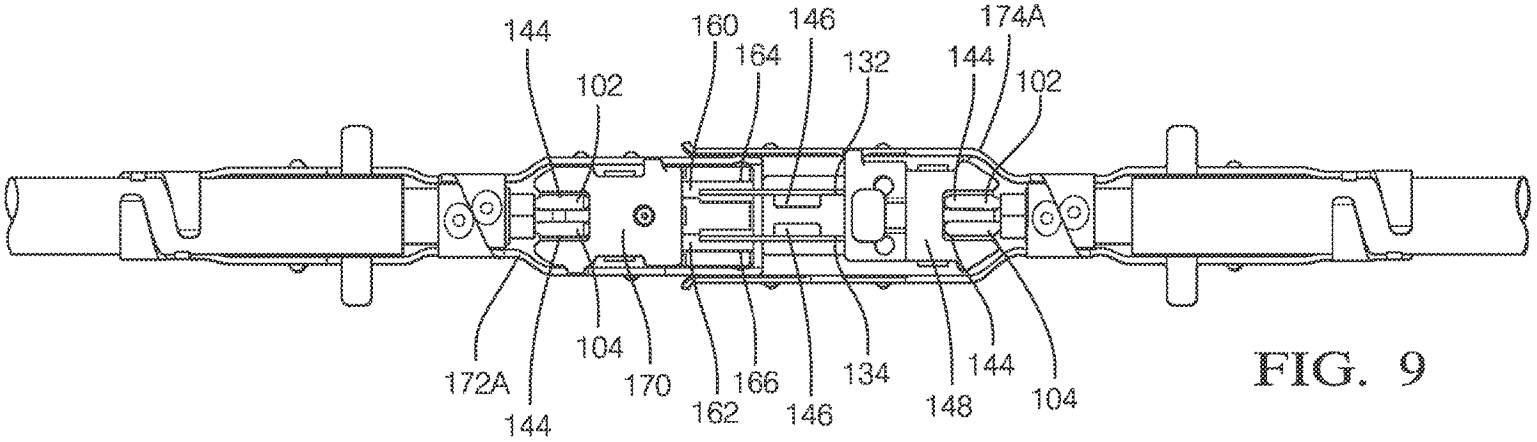
FIG. 9 is a top plan view of the electrical connector system of FIG. 7 in accordance with one embodiment.
Figure 10:
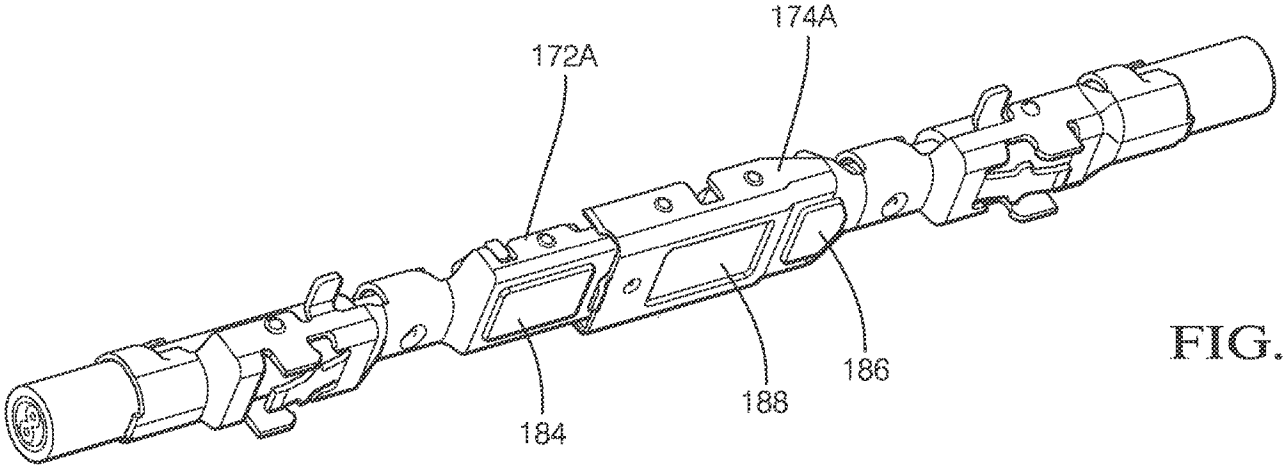
FIG. 10 is a perspective bottom view of the electrical connector system of FIG. 9 in accordance with one embodiment.
Figure 11:
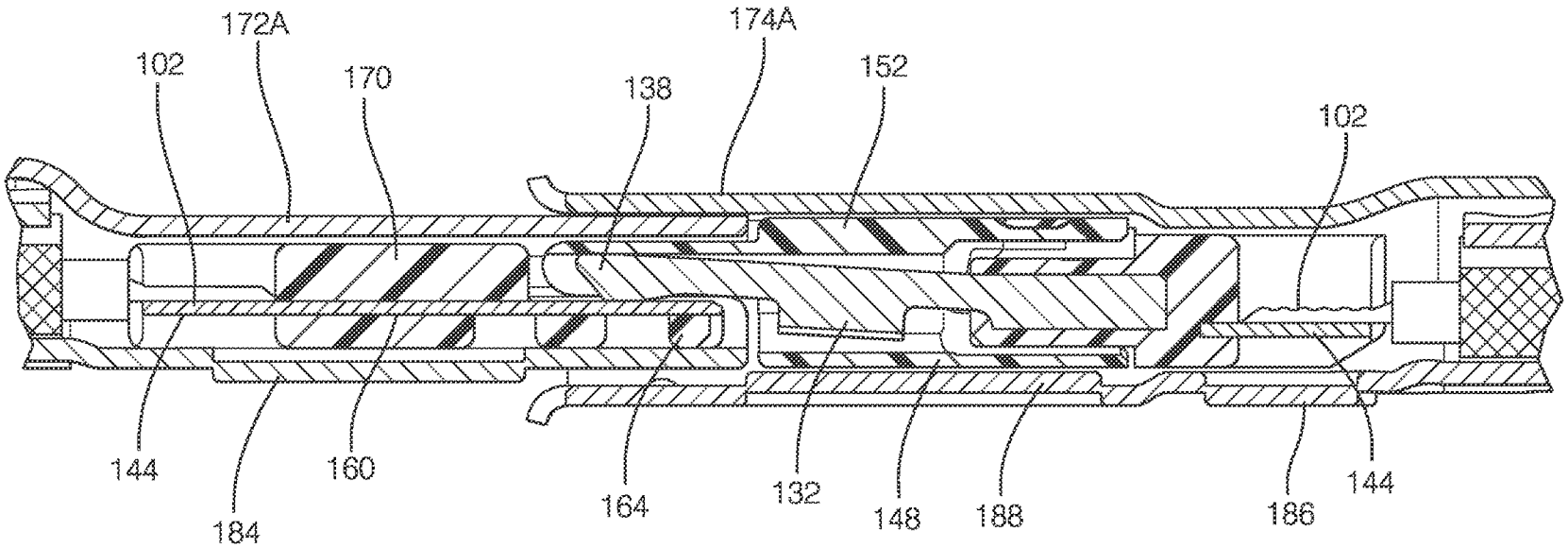
FIG. 11 is a cross section view of the electrical connector system of FIG. 9 in accordance with one embodiment.

As illustrated in FIG. 8, the receptacle connector 128 include two terminals, a first receptacle terminal 132 connected to a first inner conductor 102 and a second receptacle terminal 134 connected to a second inner conductor (not shown due to drawing perspective) of the wire cable 100. The first receptacle terminal 132 includes a first cantilever beam portion 136 that has a generally rectangular cross section and defines a convex first contact point 138 that depends from the first cantilever beam portion 136 near the free end of the first cantilever beam portion 136. The second receptacle terminal 134 also includes a similar second cantilever beam portion 140 having a generally rectangular cross section and defining a convex second contact point 142 depending from the second cantilever beam portion 140 near the free end of the second cantilever beam portion 140. As best shown in FIG. 9, the first and second receptacle terminals 132, 134 each comprise an attachment portion 144 that is configured to receive the end of an inner conductor of the wire cable 100 and provide a surface for attaching the first and second inner conductors 102, 104 to the first and second receptacle terminals 132, 134. The attachment portions 144 are configured to maintain the consistent spacing S between the first and second inner conductors 102, 104. A receptacle terminal holder 148 partially encases the first and second receptacle terminal 132, 134. The receptacle terminal holder 148 maintains the spatial relationship between the first and second receptacle terminals 132, 134 to maintain the consistent spacing S between the first and second inner conductors 102, 104. The first and second receptacle terminals 132, 134 form a mirrored terminal pair that has bilateral symmetry about the longitudinal axis X and are substantially parallel to the longitudinal axis X and each other. In the illustrated embodiment, the distance between the first cantilever beam portion 136 and the second cantilever beam portion 140 is 2.85 mm, center to center. The first and second inner conductors 102, 104 of the wire cable 100 are attached to the attachment portions 144 of the first and second receptacle terminals 132, 134 using an ultrasonic welding process.

As best shown in FIG. 9, the first and second receptacle terminals 132, 134 each define a inwardly extending tab 146 such that the first receptacle terminal defines a tab 146 extending toward the second receptacle terminal and the second receptacle terminal defines a tab 146 extending toward the tab 146 of the first receptacle terminal. The tabs 146 serve to increase capacitive coupling between the first and second receptacle terminals 132, 134

Referring once again to FIG. 8, the plug connector 130 includes two terminals, a first plug terminal 160 connected to a first inner conductor 102 and a second plug terminal 162 connected to a second inner conductor 104 of the wire cable 100. As best shown in FIG. 9, the first plug terminal 160 includes a first elongate planar portion 164 that has a generally rectangular cross section. The second plug terminal 162 also includes a similar second elongate planar portion 166. The planar portions of the plug terminals are configured to receive and contact the first and second contact points 138, 142 of the first and second receptacle terminals 132, 134. The free ends of the planar portions have a beveled shape to allow the mating first and second receptacle terminals 132, 134 to ride up and over free ends of the first and second planar portions 164, 166 when the plug connector 130 and receptacle connector 128 are mated. The first and second plug terminals 160, 162 each comprise an attachment portion 144 similar to the attachment portions 144 of the first and second receptacle terminals 132, 134 that are configured to receive the ends of the first and second inner conductors 102, 104 and provide a surface for attaching the first and second inner conductors 102, 104 to the first and second plug terminals 160, 162. The attachment portions 144 are configured to maintain the consistent spacing between the first and second inner conductors 102, 104. A plug terminal holder 170 partially encases the first and second plug terminals 160, 162. The plug terminal holder 170 maintains the spatial relationship between the first and second plug terminals 160, 162 to maintain the consistent spacing S between the first and second inner conductors 102, 104. The first and second plug terminals 160, 162 form a mirrored terminal pair that has bilateral symmetry about the longitudinal axis X and are substantially parallel to the longitudinal axis X and each other. In the illustrated embodiment, the distance between the first planar portion and the second planar portion is 2.85 mm, center to center. The inventors have observed through data obtained from computer simulation that the mirrored parallel receptacle terminals and plug terminals have a strong effect on the high speed electrical properties, such as impedance and insertion loss, of the wire cable assembly. The first and second inner conductors 102, 104 of the wire cable 100 are attached to the attachment portions 144 of the first and second plug terminals 160, 162 using an ultrasonic welding process.

As illustrated in FIG. 8, the first and second plug terminals 160, 162 and the first and second receptacle terminals 132, 134 are oriented in the plug and receptacle connectors 128, 130 so that when the plug and receptacle connectors 128, 130 are mated, the major widths of the first and second receptacle terminals 132, 134 are substantially perpendicular to the major widths of the first and second plug terminals 160, 162. As used herein, substantially perpendicular means that the major widths are ±15° of absolutely perpendicular. The inventors have observed that this orientation between the first and second plug terminals 160, 162 and the first and second receptacle terminals 132, 134 has strong effect on insertion loss. Also, when the plug and receptacle connectors 128, 130 are mated, the first and second receptacle terminals 132, 134 overlap the first and second plug terminals 160, 162. The plug and receptacle connectors 128, 130 are configured so that only the first and second contact points 138, 142 of the first and second receptacle terminals 132, 134 contacts the planar blade portion of the first and second plug terminals 160, 162 and the contact area defined between the first and second receptacle terminals 132, 134 and the first and second plug terminals 160, 162 is less than the area overlapped between the first and second receptacle terminals 132, 134 and the first and second plug terminals 160, 162. Therefore, the contact area, sometimes referred to as the wipe distance, is determined by the area of the first and second contact points 138, 142 and not by the overlap between the terminals. Therefore, the receptacle and plug terminals provide the benefit of providing a consistent contact area as long as the first and second contact points 138, 142 of the first and second receptacle terminals 132, 134 are fully engaged with the first and second plug terminals 160, 162. Because both the plug and receptacle terminals are a mirrored pair, a first contact area between the first receptacle terminal 132 and the first plug terminal 160 and a second contact area between the second receptacle terminal 134 and the second plug terminal 162 are substantially equal. As used herein, substantially equal means that the contact area difference between the first contact area and the second contact area is less than 0.1 $mm^2$. The inventors have observed through data obtained from computer simulation that the contact area between the plug and receptacle terminals and the difference between the first contact are a and the second contact area have a strong impact on insertion loss of the wire cable assembly.

The first and second plug terminals 160, 162 are not received within the first and second receptacle terminals 132, 134, therefore the first contact area is on the exterior of the first plug terminal 160 and the second contact area is on the exterior of the second plug terminal 162 when the plug connector 130 is mated to the receptacle connector 128.

The first and second receptacle terminals 132, 134 and the first and second plug terminals 160, 162 may be formed from a sheet of copper-based material. The first and second cantilever beam portions 136, 140 and the first and second planar portions 164, 166 may be selectively plated using copper/nickel/silver based plating. The terminals may be plated to a 5 skin thickness. The first and second receptacle terminals 132, 134 and the first and second plug terminals 160, 162 are configured so that the receptacle connector 128 and plug connector 130 exhibit a low insertion normal force of about 0.4 Newton (45 grams). The low normal force provides the benefit of reducing abrasion of the plating during connection/disconnection cycles.

As illustrated in FIG. 8, the plug connector 130 includes a plug shield 172 that is attached to the outer shield 124 of the wire cable 100. The plug shield 172 is separated from and longitudinally surrounds the first and second plug terminals 160, 162 and plug terminal holder 170. The receptacle connector 128 also includes a receptacle shield 174 that is attached to the outer shield 124 of the wire cable 100 that is separated from and longitudinally surrounds the first and second receptacle terminals 132, 134, receptacle terminal holder 148 and receptacle terminal cover 152. The receptacle shield 174 and the plug shield 172 are configured to slidingly contact one another and when mated, provide electrical continuity between the outer shields of the attached wire cables 100 and electromagnetic shielding to the plug and receptacle connectors 128, 130.

As shown in FIG. 8, the plug shield 172 is made of two parts, a first plug shield 172A and a second plug shield 172B. The first plug shield 172A includes two pairs of crimping wings, conductor crimp wings 176 and insulator crimp wings 178, adjacent an attachment portion configured to receive the wire cable 100. The conductor crimp wings 176 are bypass-type crimp wings that are offset and configured to surround the exposed outer shield 124 of the wire cable 100 when the conductor crimp wings 176 are crimped to the wire cable 110. The drain wire 120 is electrically coupled to the first plug shield 172A when the first plug shield 172A is crimped to the outer shield 124 because the drain wire 120 of the wire cable 100 is sandwiched between the outer shield 124 and the inner shield 116 of the wire cable 110. This provides the benefit of coupling the plug shield 172 to the drain wire 120 without having to orient the drain wire 120 in relation to the shield before crimping. Other embodiments of the wire cable may be envisioned that do not include a drain wire.

The insulation crimp wings are also bypass type wings that are offset and configured to surround the jacket 126 of the wire cable 100 when the plug shield 172 is crimped to the wire cable 110.

The first plug shield 172A defines an outwardly embossed portion 184 that is proximate to the connection between the attachment portions 144 of the plug terminals and the first and second inner conductors 102, 104. The embossed portion 184 increases the distance between the attachment portions 144 and the first plug shield 172A, thus decreasing the capacitive coupling between them.

As shown in FIG. 8, the receptacle shield 174 is similarly made of two parts, a first receptacle shield 174A and a second receptacle shield 174B. The first receptacle shield 174A includes two pairs of crimping wings, conductor crimp wings 176 and insulator crimp wings 178, adjacent an attachment portion configured to receive the wire cable 110. The conductor crimp wings 176 are bypass-type crimp wings that are offset and configured to surround the exposed outer shield 124 of the wire cable 100 when the conductor crimp wings 176 are crimped to the wire cable 100.

The insulation crimp wings are also bypass type wings that are offset and configured to surround the jacket 126 of the wire cable 100 when the plug shield 172 is crimped to the wire cable 100.

The first receptacle shield 174A defines an outwardly embossed portion 186 that is proximate to the connection between the attachment portions 144 of the plug terminals and the first and second inner conductors 102, 104. The embossed portion 186 increases the distance between the attachment portions 144 and the first plug shield 172A, thus decreasing the capacitive coupling between the attachment portions 144 and the receptacle shield 174. The first receptacle shield 174A further defines an inwardly embossed portion 188 that is proximate the location of the tabs 146 of the first and second receptacle terminals 132, 134. This inwardly embossed portion 188 decreases the distance between the first and second tabs 146 and the receptacle shield 174 thus increasing capacitive coupling between the first and second receptacle terminals 132, 134 and the receptacle shield 174.

While the exterior of the plug shield 172 of the illustrated example is configured to slideably engage the interior of the receptacle shield 174, alternative embodiments may be envisioned wherein the exterior of the receptacle shield 174 slideably engages the interior of the plug shield 172.

The receptacle shield 174 and the plug shield 172 may be formed from a sheet of copper-based material. The receptacle shield 174 and the plug shield 172 may be plated using copper/nickel/silver or tin based plating. The first and second receptacle shield 174A, 174B and the first and second plug shield 172A, 172B may be formed by stamping processes well known to those skilled in the art.

Figure 12:
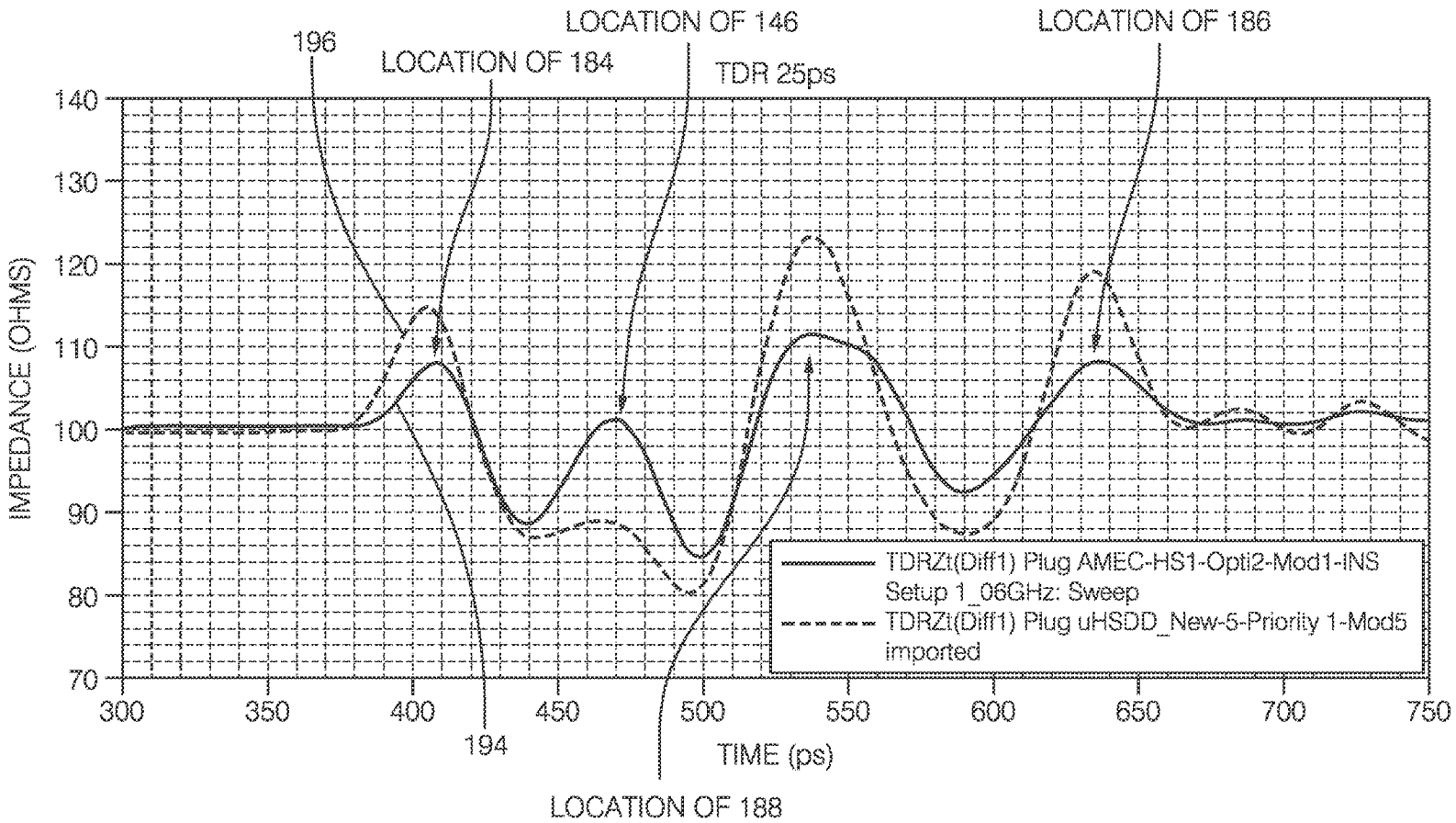
FIG. 12 is a graph of the impedance along the length of the electrical connector system of FIG. 9 in accordance with one embodiment.

As illustrated in FIG. 12, the features of the connector system, including the spacing of the attachment portions 144 to maintain the consistent spacing S of the wire cable, the tabs 146 of the first and second receptacle terminals 132, 134 that increase capacitive coupling between the first and second receptacle terminals 132, 134, the inwardly embossed portion 188 of the receptacle shield that decreases capacitive coupling between the tabs 146 of the first and second receptacle terminals 132, 134 and the receptacle shield 174, and the outwardly embossed portion 184 of the plug shield 172 and the outwardly embossed portion 186 of the receptacle shield 174 that increase capacitive coupling between the first and second receptacle terminals 132, 134 and the receptacle shield 174 and the first and second plug terminals 160, 162 and the plug shield 172 all cooperate to provide more consistent impedance along the length of the connector system 194 than provided by previous connector system designs 196, such as one presented in U.S. Pat. No. 9,142,907.

While the examples of the plug connector and receptacle connector illustrated herein are connected to a wire cable, other embodiments of the plug connector and receptacle connector may be envisioned that are connected to conductive traces on a circuit board.

To meet the requirements of application in an automotive environment, such as vibration and disconnect resistance, the wire cable assembly may further include a receptacle connector body 190 and a plug connector body 192 as illustrated in FIG. 6. The receptacle connector body 190 and the plug connector body 192 are formed of a dielectric material, such as a polyester material.

Accordingly, a connector assembly is provided. The connector assembly is suited for terminating wire cables 100 is capable of transmitting digital data signals with data rates of 3.5 Gb/s or higher without modulation or encoding. The connector assembly provide the benefit of impedance matching by maintaining a consistent electrical impedance along the length of the connector system, thereby reducing signal degradation.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

Further, the limitations of the following claims are not written in means-plus-function format and are not intended to be interpreted based on 35 USC § 112(f), unless and until such claim limitations expressly use the phrase "means for" followed by a statement of function void of further structure.

We claim:

1. An electrical connection system, comprising:

a first electrical conductor and a second electrical conductor, wherein a first consistent spacing is maintained between the first and second electrical conductors;

a third electrical conductor and a fourth electrical conductor, wherein a second consistent spacing is maintained between the between the third and fourth electrical conductors;

a plug connector having a first plug terminal including a planar first connection portion characterized by a generally rectangular cross section and a first attachment portion attached to the first electrical conductor and having a second plug terminal including a planar second connection portion characterized by a generally rectangular cross section and a second attachment portion attached to the second electrical conductor, wherein a spacing between the first and second attachment portions maintains the first consistent spacing between the first and second electrical conductors, wherein the first and second plug terminals form a first mirrored terminal pair having bilateral symmetry about a longitudinal axis; and a receptacle connector configured to mate with said plug connector having a first receptacle terminal including a third attachment portion attached the third electrical conductor and a first cantilever beam portion characterized by a generally rectangular cross section defining a convex first contact point depending from the first cantilever beam portion, said first contact point configured to contact the first connection portion of the first plug terminal and having a second receptacle terminal including a fourth attachment portion attached to the fourth electrical conductor and having a second cantilever beam portion characterized by a generally rectangular cross section defining a convex second contact point depending from the second cantilever beam portion, said second contact point configured to contact the second connection portion of the second plug terminal, wherein a spacing between the third and fourth attachment portions maintains the second consistent spacing between the third and fourth electrical conductors, wherein the first and second receptacle terminals form a second mirrored terminal pair having bilateral symmetry about the longitudinal axis and wherein when the plug connector is connected to the receptacle connector, a major width of the first connection portion is substantially perpendicular to a major width of the first cantilever beam portion and a major width of the second connection portion is substantially perpendicular to a major width of the second cantilever beam portion.

2. The electrical connection system according to claim 1, wherein the first receptacle terminal defines a first tab extending inwardly toward the second receptacle terminal and wherein the second receptacle terminal defines a second tab extending inwardly toward the first receptacle terminal, thereby decreasing a distance between the first and second receptacle terminals and increasing capacitive coupling between the first and second receptacle terminals.

3. The electrical connection system according to claim 1, wherein the first and second plug terminals are partially encased within a plug terminal holder formed of a dielectric material and configured to maintain a lateral separation of the first and second attachment portions.

4. The electrical connection system according to claim 1, wherein the first and second receptacle terminals are partially encased within a receptacle terminal holder formed of a dielectric material and configured to maintain lateral separation of the third and fourth attachment portions.

5. The electrical connection system according to claim 4, wherein the receptacle terminal holder defines a pair of channels adjacent the first and second receptacle terminals configured to allow vertical deflection of the first and second receptacle terminals.

6. The electrical connection system according to claim 1, further comprising:

a plug shield electrically isolated from the plug connector and configured to be attached to a first shield conductor and to longitudinally surround the plug connector; and a receptacle shield electrically isolated from the receptacle connector and configured to be attached to a second shield conductor and to longitudinally surround the receptacle connector, wherein the receptacle shield is configured to slideably engage an interior of the plug shield.

7. The electrical connection system according to claim 6, wherein the receptacle shield defines an inward embossment proximate a location of a first tab of the first receptacle terminal and the second tab extending of the second receptacle terminal, thereby decreasing a distance between the first and second tabs and the receptacle shield and increasing capacitive coupling between the first and second receptacle terminals and the receptacle shield.

8. The electrical connection system according to claim 1, wherein the first and second electrical conductors are selected from the group consisting of wire conductors within a shielded wire cable and conductive circuit board traces.

9. The electrical connection system according to claim 8, wherein the plug shield defines an outward embossment proximate a location of the first and second attachment portions of the first and second plug terminals, thereby increasing a distance between the first and second attachment portions and the plug shield and decreasing capacitive coupling between the first and second plug terminals and the plug shield.

10. The electrical connection system according to claim 8, wherein the receptacle shield defines an outward embossment proximate a location of the third and fourth attachment portions of the first and second receptacle terminals, thereby increasing a distance between the third and fourth attachment portions and the receptacle shield and decreasing capacitive coupling between the first and second receptacle terminals and the receptacle shield.

11. The electrical connection system according to claim 1, wherein the third and fourth electrical conductors are selected from the group consisting of wire conductors within a shielded wire cable and conductive circuit board traces.

* * * * *